US005529605A

United States Patent [19]

Müssig et al.

[11] Patent Number: 5,529,605

[45] Date of Patent: Jun. 25, 1996

[54] METHOD AND APPARATUS FOR REMOVING MERCURY FROM CONTAMINATED PIPES AND INSTALLATION PARTS, IN PARTICULAR MERCURY INTRODUCED BY NATURAL GAS

[75] Inventors: Siegfried Müssig, Bad Nenndorf; Hans Kaast, Kleinburgwedel; Friedrich Schlemm, Hanover, all of Germany

[73] Assignee: BEB Erdgas und Erdol GmbH, Hanover, Germany

[21] Appl. No.: 122,924

[22] Filed: Sep. 17, 1993

[51] Int. Cl.[6] ..... C22B 43/00

[52] U.S. Cl. ..... 75/670; 266/148; 266/149; 266/165; 134/22.12; 134/166 C; 134/22.11; 137/15; 588/230

[58] Field of Search ..... 75/670; 266/148, 266/149, 165; 134/22.11, 22.12, 166 C; 137/15, 238; 588/230

[56] References Cited

U.S. PATENT DOCUMENTS 4,849,026 7/1989 Steinhaus ..... 134/22.12

5,354,357 10/1994 Markovs et al. ..... 75/670

*Primary Examiner*—Melvyn Andrews

*Attorney, Agent, or Firm*—Emmanuel J. Lobato

[57] ABSTRACT

Pipe lines for conducting natural gas become contaminated, over a period of time, by an accumulation of mercury, which occurs in minute amounts in natural gas. If used pipe is scrapped, for example by melting, mercury vapor escaping to the atmosphere poses a health hazard. To remove mercury, sections of pipe are closed at both ends by plugs having nipples for connection to a closed circuit and inert gas line connected with a pump for evacuating the line and with a source of inert gas, for example nitrogen. The closed circuit inert gas line contains a blower for circulating the inert gas repeatedly through the pipe sections and a condenser for condensing mercury vapor. The closed circuit further includes a heat exchanger for removing heat upstream of the condenser, a coordinated heat exchanger for restoring heat removed and an additional heater. The pipe sections are heated externally by an oven or internally by heated inert gas.

22 Claims, 4 Drawing Sheets

METHOD AND APPARATUS FOR REMOVING MERCURY FROM CONTAMINATED PIPES AND INSTALLATION PARTS, IN PARTICULAR MERCURY INTRODUCED BY NATURAL GAS

FIELD OF INVENTION

The invention relates to a method and apparatus for removing mercury from natural gas pipes and natural gas transport installation parts for the processing and transport of natural gas.

BACKGROUND OF THE INVENTION

It has been found that natural gas transported by pipe lines also contains mercury vapor which is discharged from natural gas deposits. The mercury vapor precipitates as mercury in the pipes and installation parts. Mercury vapor as a contamination in natural gas occurs in extremely small amount, but after years of use of the natural gas pipelines, mercury and possibly mercury compounds are found in such quantities that when the conduits are scrapped, the pipes must not be melted down, for environmental reasons, because the mercury, rising in vapor form into the atmosphere during the melting down, would poison the air for a long time.

Therefore, wherever mercury vapors are not filtered out from the start as the crude gases enter the installations, it is necessary to clean conduits and installation parts. This necessity exists not only where old natural gas lines are to be disposed of, but also where still usable lines are to remain in use. For whatever work is being done on these lines, whether to weld in outlet pipes or to carry out other repairs, there is always a health hazard for the persons on the site and danger of pollution.

SUMMARY OF THE INVENTION

The object of the present invention therefore is to provide possibilities for the removal of mercury and mercury compounds from contaminated pipes and installation parts that can be carried into effect at low cost and with simple means.

The invention consists in that the conduit is cut, at cold temperature, into pipe segments; after each cut, the severed segment is raised into an inclined or vertical position, the content of solids and liquids in the segment is allowed to run out into a vessel placed under the lower pipe end, then both ends of the segment are closed by plugs and the segment is transported to an evaporation station, where the segment is filled with inert gas through nipples in the plugs, the inert gas-filled segment is heated, thereby breaking down the existing mercury compounds and evaporating the existing mercury, and the inert gas containing the heated mercury vapor is transferred into a condenser, in which the inert gas containing the mercury vapor is cooled until the mercury precipitates from the inert gas.

With this method, mercury can be removed from the natural gas conduits and installation parts except for undetectable residues and the mercury can be recovered as reusable raw material.

In carrying out this process, it is desirable to change the inert gas filling of the pipe section several times, preferably by circulation. This makes sure that every last trace of mercury vapor is discharged from the pipe section.

Advantageously, the procedure in carrying out the method is first to evacuate the pipe segment in order to remove oxygen from the segment to the extent possible. Appropriately nitrogen is used as inert gas. In terms of energy it is advantageous for carrying out the process to keep the inert gas filling under vacuum at least during the heating of the pipe.

For carrying out the process, the segment may be heated by external heat to a temperature above the vaporization temperature of mercury, then replacing the inert gas filling of the pipe with mercury vapor-free inert gas, preferably several times, by circulation, and sending it to the condenser.

Another possibility is to heat the pipe segment by introducing hot inert gas which has been heated to a temperature above the vaporization temperature of mercury, that is, to supply the heat to the pipe with the inert gas from the interior, the advantage being that the inner wall, where the mercury to be discharged is located, is heated more effectively than the outer wall of the pipe.

For this form of execution of the process it is desirable to move the inert gas through the pipe in circulation many times, heating it outside the pipe to be cleaned before exhausting it from the circulation and sending it to the condenser. For this purpose a U- or C- shaped conduit arrangement is used, between the ends of which the pipe to be cleaned is clamped and which has heating devices for the inert gas inside it.

Such a heating device could be accommodated also inside the pipe section to be cleaned.

The pipe segments thus cleaned can, depending on their state of preservation, be re-used or be melted down as scrap without a problem.

If it is desired to clean existing natural gas conduits for continued use without cutting the conduit apart, the procedure is appropriately to close the conduit off on both sides of the section to be cleaned, to evacuate the gases from the closed-off section, preferably via a purification device, and to replace them by inert gas, to heat the pipe section by section, flushing it with the inert gas preferably under vacuum, whereupon the mercury vapor present in the inert gas is withdrawn therefrom by condensation. Appropriately the heating device is mounted on a truck, which is moved along the natural gas line to be cleaned.

In the practice of this process, the appropriate procedure is to let the inert gas propagate in the pipe to be cleaned in the direction in which the heating device is being moved. It is thereby achieved that mercury cannot precipitate again in the cleaned pipe segment. Also it suffices to heat intensively only a short pipe segment each time.

In all cases it is desirable to remove the pipe insulation before the heat treatment and to apply a new one after the treatment if the pipe or pipe segments are to continue being used buried.

The apparatus for removal of mercury from contaminated pipes consists of a inert gas tank, a heating device, an evacuation device, a condenser, and a suction device, which are interconnected by conduits in which the pipe or conduit part to be cleaned are inserted.

Appropriately the heating device consists of a furnace or oven surrounding the pipe segment to be cleaned, or of an inert gas heater to be introduced into the pipe segment to be cleaned, or of an inert gas heater arranged outside the pipe segment to be cleaned, or of a burner surrounding the pipe segment to be cleaned, or of a heating device operated with electric current or electromagnetic waves. Also the use of superheated steam is possible.

It is appropriate to use an inert gas closed circuit in which are arranged a device for introducing the pipe to be cleaned and the heating device, and in which there is arranged a feeder line which leads to the condenser.

Appropriately the feeder is also a closed circuit, connected to the inert gas circuit at two points.

BRIEF DESCRIPTION OF THE DRAWINGS

The essence of the present invention is explained more specifically below with reference to exemplary embodiments shown schematically in the drawings, in which.

DESCRIPTION OF PREFERRED EMBODIMENTS

Figure 1:
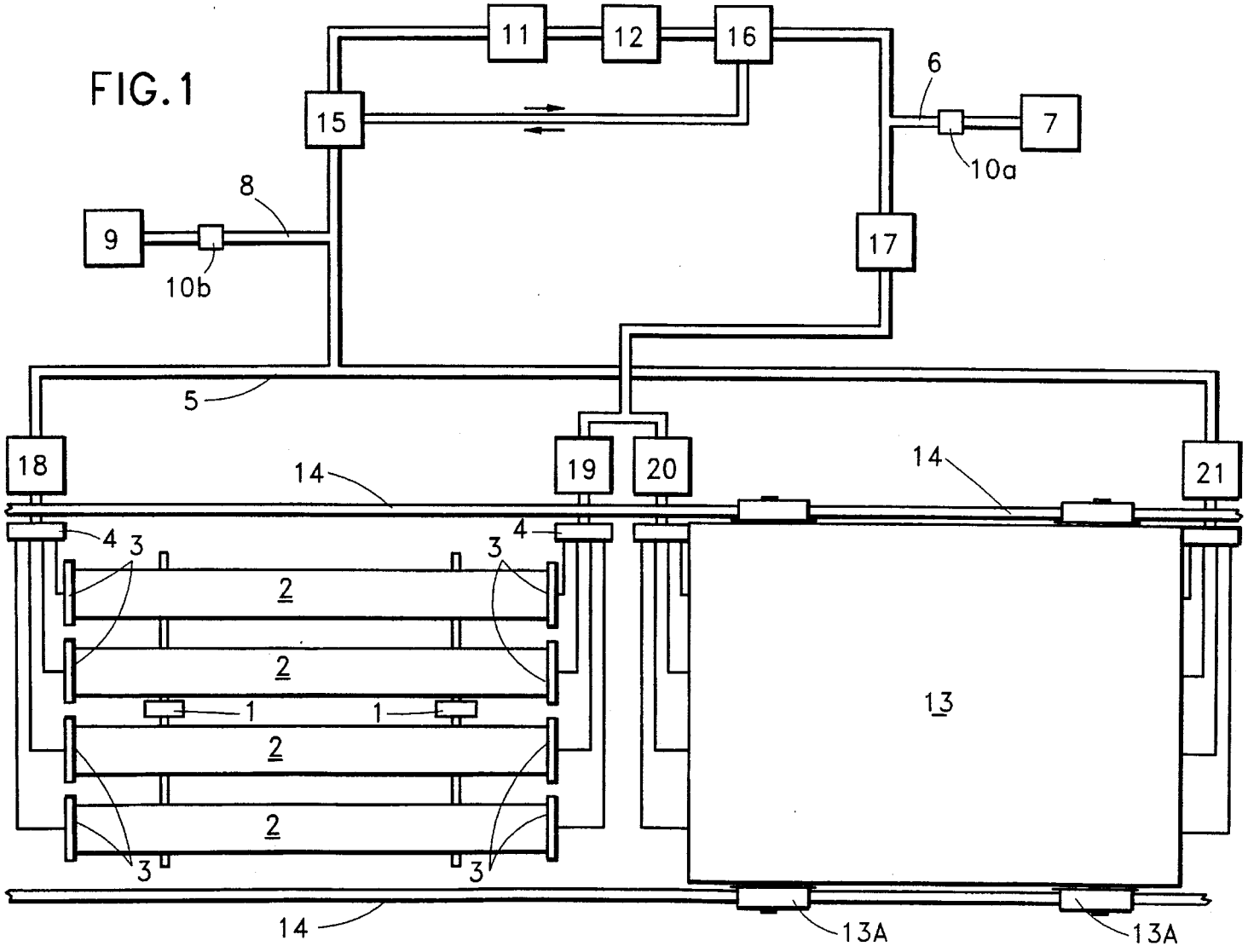
FIG. 1 is a schematic view of cleaning apparatus with a movable furnace for heating pipe segments cut out of a pipe line.

On stands 1 are mounted pipes 2 which are to be cleaned. Ends of the pipes 2 are closed by plugs 3 in which there are nipples to which a closed circuit inert gas line 5 is connected. Connected to the inert gas line 5 by a branch line 6 and valve 10*a* is a vacuum pump through which the pipes 2 are evacuated. An inert gas source 9 is connected to the inert gas line 5 by a feeder line 8 and valve 10*b*.

The inert gas line 5 is a closed circuit connected through connecting blocks 4 and through the nipples in plugs 3 with opposite ends the pipes on the stands 1. The inert gas line 5 circuit includes a condenser 11 in which mercury vapor withdrawn from the pipes is precipitated as liquid mercury. The inert gas line 5 circuit further includes a blower 12 with which the inert gas steam is circulated through the closed circuit.

The inert gas is cooled in the condenser 11 to a point at which the mercury is condensed. Hence, the inert gas leaves the condenser at a low temperature. It is desirable to heat the inert gas again downstream the condenser 11 so that it will re-enter the pipes 2 at a temperature higher than the vaporization temperature of mercury. To this end, there are provided in the closed circuit inert gas line 5 two coordinated and interconnected heat exchangers 15 and 16 of which heat exchanger 15 reduces temperature of the inert gas entering the condenser 11 while in heat exchanger 16 the heat released in the heat exchanger 15 is added again to the cooled inert gas leaving the condenser. As this is possible only to a limited extent, the heat exchanger 16 is followed by a heating device 17.

The pipes 2 and the inert gas in the pipes are heated by warm air oven 13. In the embodiment shown in FIG. 1 there are two sets of pipes 2 on two sets of stands 1 and an oven 13 is movable by wheels 13a on tracks 14 between a position in which the oven covers one set of pipes to a position in which it covers the other set of pipes. As shown in FIG. 1, the oven covers the right hand set of pipes, which accordingly do not show. By opening valves 20, 21, the right hand is connected to the inert gas line closed circuit 5. At the same time valves 20 and 21 are opened, valves 18 and 19 are closed so that no inert gas can flow through the pipes of the other station. When valves 18, 19 are closed, the pipes are allowed to cool, then the plugs 3 are removed on both sides, the treated pipes are taken out and replaced by pipes to be treated, closing them with plugs 3, thus preparing the next operation, which is initiated when the values 20, 21 are closed, valves 18, 19 are opened, and the warm-air oven 13 is pushed over the station with the open valves 18, 19.

Figure 2:
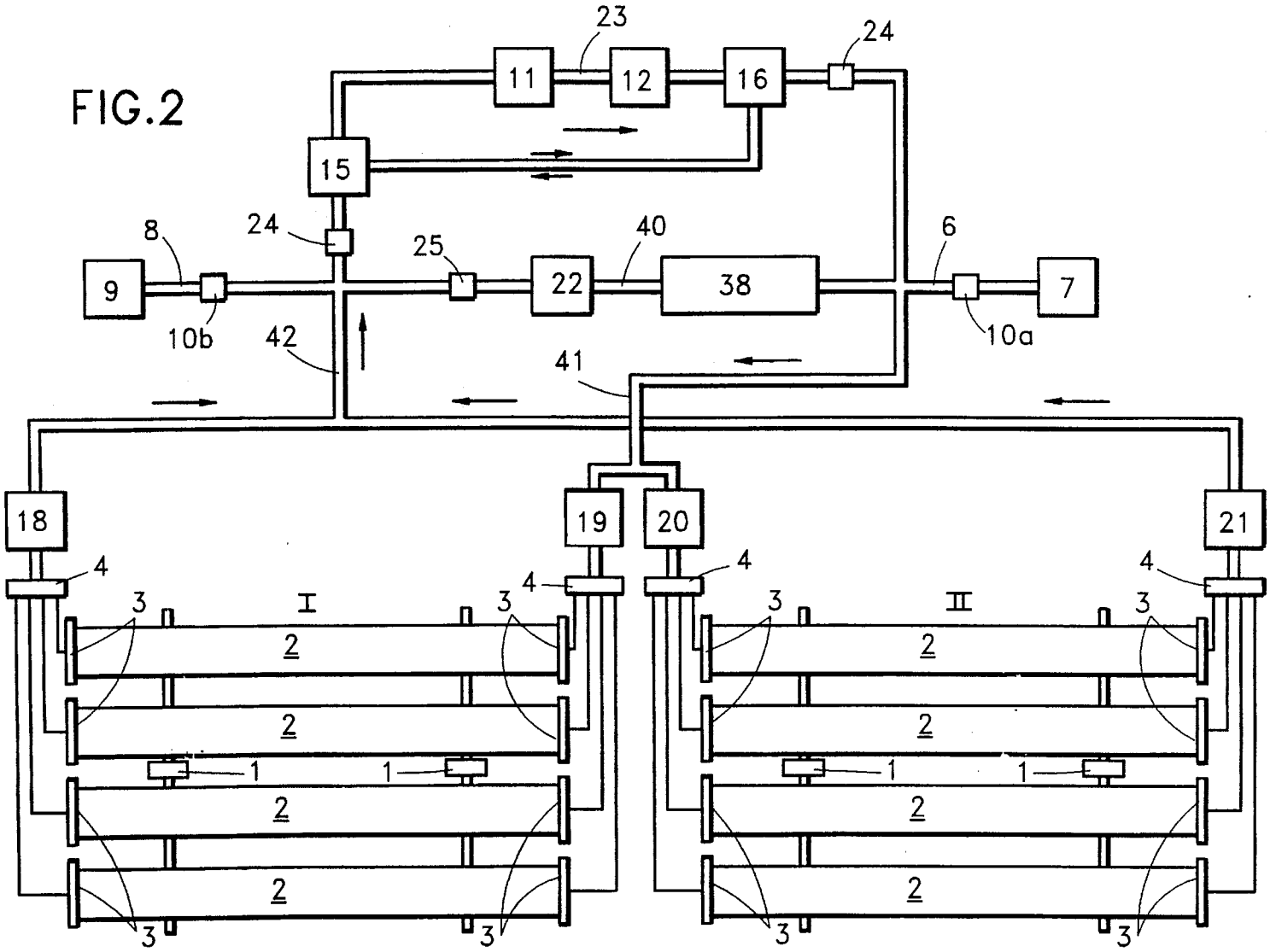
FIG. 2 is a schematic view of cleaning apparatus in which the pipe segments are heated from the inside by a warmed inert medium.

In the example of FIG. 2, the pipes 2 are heated, not from the outside by a warm-air oven, but from inside by intensely heated inert gas. Here, too, two stacks of pipes I, II are provided, which are subjected to treatment alternately. When stack I is being treated with hot inert gas, the pipes of stack II cool off and are exchanged for pipes to be treated. Here also valves 18, 19, 20, 21 are provided in order to introduce only one stack of pipes into the treatment process each time. This treatment process of heating from the inside by inert gas has the advantage that all of the mercury will have vaporized already when the outer wall of pipe 2 exceeds the vaporization temperature of mercury. This method can be carried out energy-efficiently if the closed circuit inert gas system is divided into two loops: a loop comprising a conduit 41 leading to the stack of pipes, a conduit 42 coming from the stack of pipes, and a conduct 40 connecting these two conduits, in which a heating device 38 and a blower 22 are provided. A second loop 23 parallels the conduit 40 and is connectable by valves 24 to both ends of line 40. This second loop 23 contains the condenser 11, the blower 12, and the heat exchangers 15 and 16. Here too an inert gas source 9 and a vacuum pump 7 are connected to the conduit system in like manner. A valve 25 is used for closing line 40. Lines 40 and 23 are operated alternately, that is, when line 40 is closed by valve 25, valves 24 is open, whereas valve 25 is open when valves 24 are closed.

This device operates as follows:

With valve 25 open, valves 24 closed, and valve 10*a* open, air is evacuated from the installation by the vacuum pump 7, preferably via purification devices. At the same time, with valve 10*b* open, inert gas from source 9 is introduced into the line until all air is replaced by inert gas. Then the inert gas heating system is turned on. Blower 2 forces the hot inert gas into the pipes 2 to be cleaned. Through line 19, the inert gas leaves the pipes again and returns through the opened valve 25 to the heating device 38. This process is continued until the outside temperature of the pipes 2 has exceeded the vaporization temperature of mercury. Thus the inert gas is pumped in continuous circulation through the pipes and through the heating device. When the vaporization temperature of mercury is exceeded on the exterior of the pipes, the heating device is turned off and valve 25 is closed, whereas the valves 24 are opened. Now, hot inert gas forced by blower 12 flows through the heat exchanger 15 into the condenser 11. Here the mercury vapor precipitates as liquid. The cooled inert gas is drawn by blower 12 and forced through the heat exchanger 16. Here the inert gas is reheated and again passes in circulation through line 41 into the pipes 2 to be cleaned. This process can be repeated.

Figure 3:
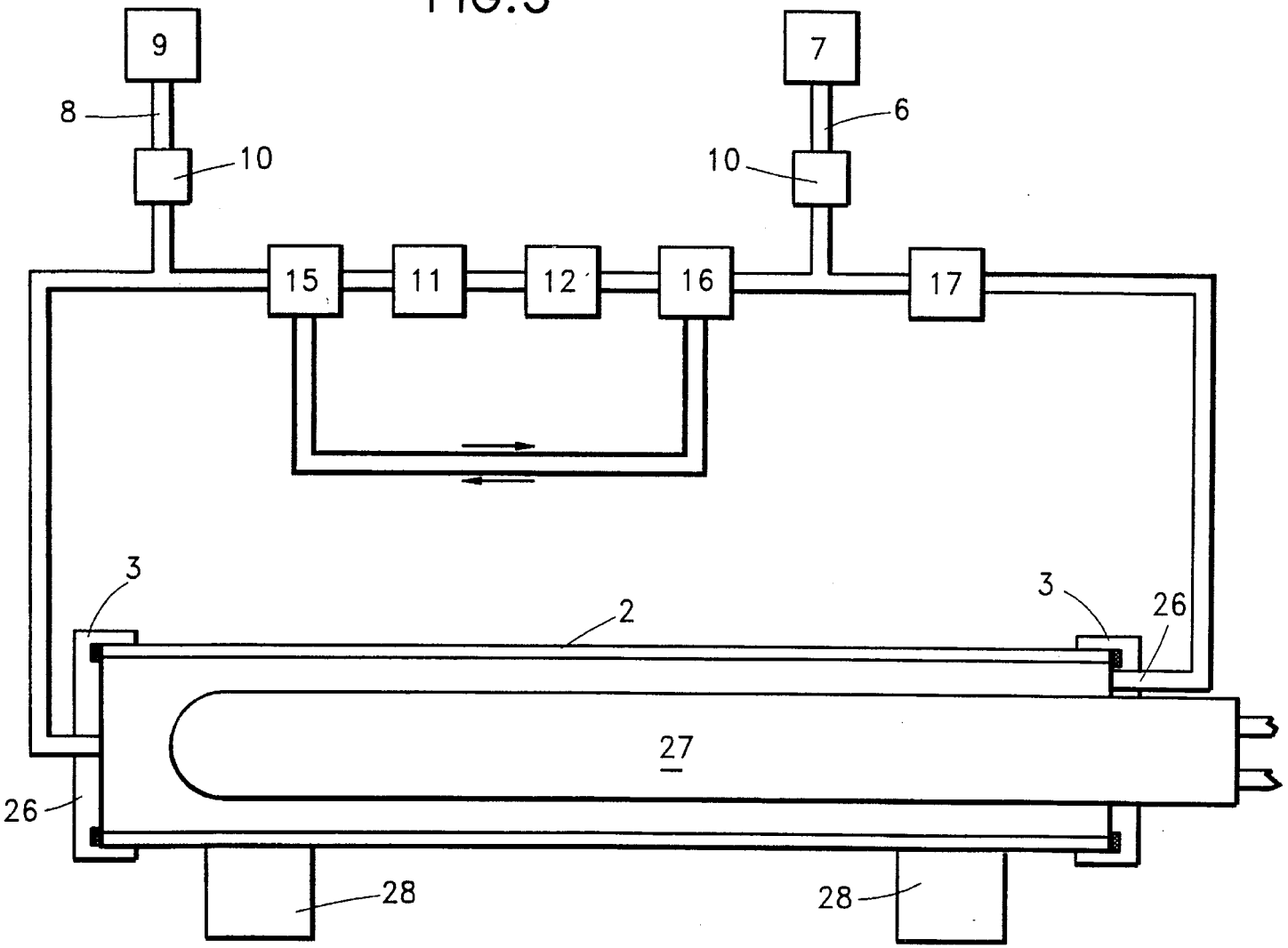
FIG. 3 is a schematic view of cleaning apparatus in which a pipe segment to be cleaned is heated from the inside, using a burner.

In the example of FIG. 3, the pipe 2 to be treated is also closed by plugs 3. These plugs have connected nipples for connection with the inert gas line 5. The latter again contains the condenser 11, the blower 12, the heat exchangers 15, 16 and a heating device 17. Also connected to this line are the vacuum pump 7 and the inert gas source 9. The heating device 17 is of low power. In fact, the bulk of the heat is supplied by a heating device 27 mounted on plug 3 and extending into the pipe. For its treatment the pipe 2 is placed on foundations 28.

Figure 4:
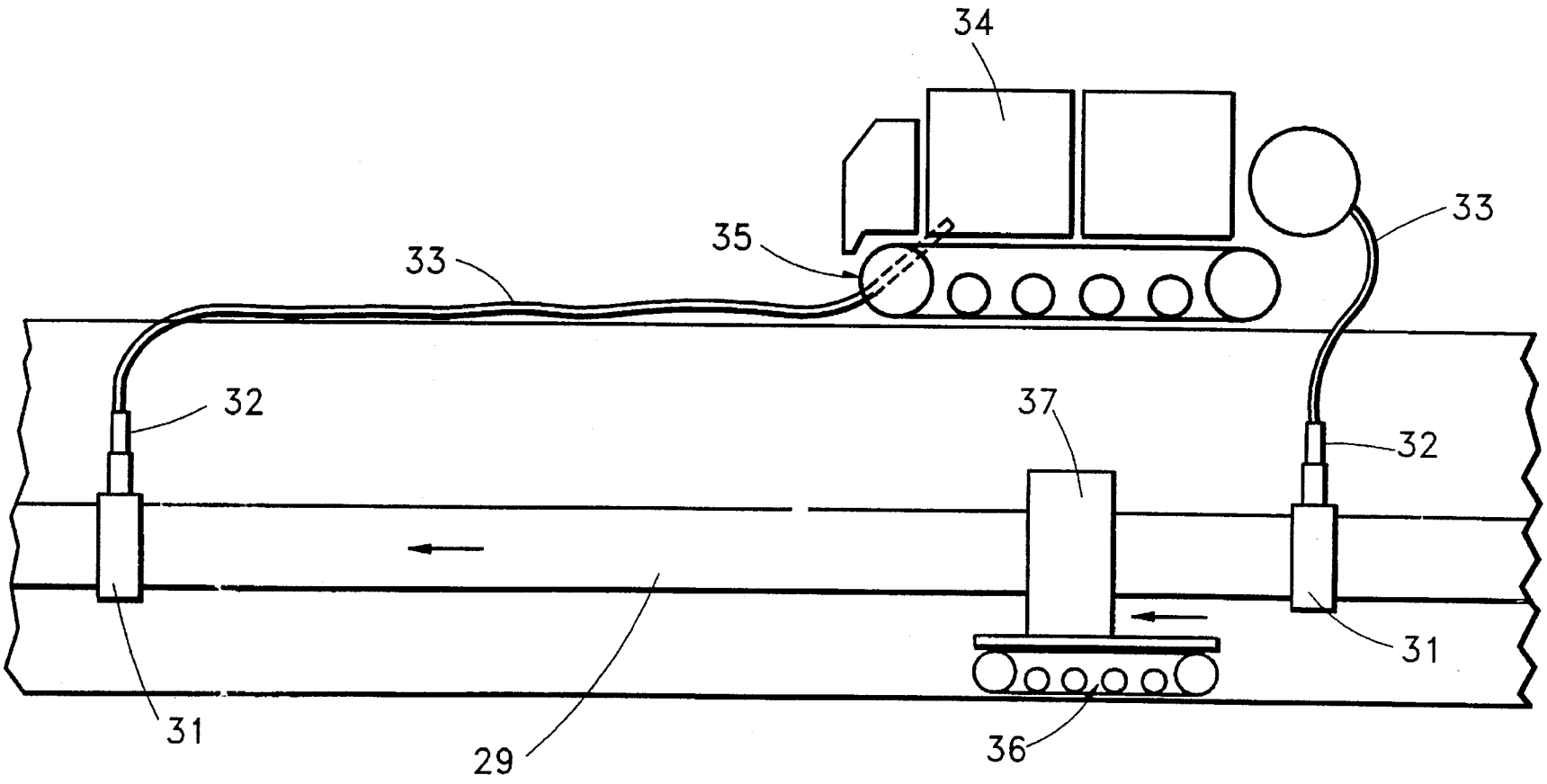
FIG. 4 is a schematic view of apparatus for cleaning an installed natural gas line.

While for the treatment of the pipes 2 in the examples of FIG. 1, 2 and 3 the natural gas pipe line must be cut into segments, allowing the segments to be cleaned, in FIG. 4 an example is shown where a buried natural gas pipe line 29 is treated. For this purpose a trench 30 is dug, the pipe line 29 is drilled open at two points and provided with tapping sleeves 31. Through these tapping sleeves 31, blocking means, e.g., blocking bubbles, have been installed in the interior of the natural gas line 29. These tapping sleeves 31 have nipples 32 for connecting a flexible tube 33 leading to the inert gas treatment chamber 34 on the vehicle 35. This treatment chamber 34 houses the condenser, blower, heat exchanger, heating device, vacuum pump, and inert gas source. The natural gas line 29 is heated by a heat source 37 mounted on a vehicle 26. The direction of the flow of the inert gas, indicated by an arrow on the natural gas line, is the same as the driving direction of vehicle 36 with the heat source 37.

What we claim is:

1. Process for removing mercury from a section of pipe for transporting natural gas which comprises closing ends of said pipe section with closures having nipples communicating with the interior of said pipe section, introducing an inert gas into the interior of said pipe section through said nipples, heating said inert gas in the interior of said pipe section to a temperature sufficiently high to vaporize mercury in said pipe section, withdrawing said heated inert gas containing mercury vapor from said pipe section and cooling said inert gas to a sufficiently low temperature to condense mercury vapor therein.

2. Process according to claim 1, in which said inert gas is repeatedly circulated through said pipe section.

3. Process according to claim 1, in which said pipe section is evacuated before said introduction of said inert gas into said interior of said pipe section.

4. Process accordingly to claim 1, in which said inert gas is maintained at a pressure below atmospheric pressure during heating of said inert gas in said pipe section.

5. Process according to claim 1, in which inert gas in the interior of said pipe section is heated by application of heat on the exterior of said pipe section.

6. Process accordingly to claim 1, in which heated inert gas is introduced into the interior of said pipe section.

7. Process according to claim 6, in which said inert gas is circulated in a circuit comprising the interior of said pipe section and means for heating said inert gas exteriorly of said pipe section.

8. Process according to claim 7, in which said inert gas is cooled in said circuit externally of said pipe section.

9. Process for removing mercury from a pipe section of a pipe line for transporting natural gas comprising closing ends of said pipe section with closures having nipples communicating with the interior of said pipe section, evacuating said pipe section, introducing an inert gas into the interior of said evacuated pipe section, heating said inert gas in the interior of said pipe section to a temperature sufficiently high to vaporize mercury in said pipe section, removing said inert gas and mercury vapor from said pipe section and cooling said inert gas to a temperature sufficiently low to condense mercury vapor in said inert gas.

10. Process according to claim 9 in which heating of inert gas in the interior of said pipe section is effected by introducing heating means for heating said inert gas through an end of said pipe section.

11. Process according to claim to claim 10, in which said inert gas is introduced into said pipe section through said end through which said heating means is introduced into said pipe section.

12. Process for removing mercury from a buried pipe line for transport natural gas, said pipe line comprising a plurality of connected pipe sections, said process comprising uncovering a pipe section of said pipe line, segregating said pipe section from said pipe line by closures at opposite ends of said segregated pipe sections, heating said segregated pipe section to vaporize mercury in the interior thereof, connecting a closed circuit inert gas line with opposite ends of the interior of said segregated pipe section, said closed circuit inert gas line comprising means for withdrawing mercury vapor from the interior of said segregated pipe sections and means for condensing said mercury vapor externally of said segregated pipe section.

13. Process according to claim 12 in which said heating of said segregated pipe section is effected by applying heat to the exterior of said segregated pipe section to vaporize mercury therein.

14. Process according to claim 12 in which said heating of said segregated pipe section is effected by introducing into the interior of said segregated pipe section heated inert gas.

15. Apparatus for removing mercury from a section of a pipe for transporting natural gas which comprises closure means for closing ends of said pipe section, said closure means having nipples providing communication with the interior of said pipe section, means for introducing an inert gas into the interior of said pipe section through said nipples, heating means for heating said inert gas in the interior of said pipe section to a temperature sufficient to vaporize mercury in said interior of said pipe section, means for withdrawing said inert gas and vaporized mercury vapor from said pipe section, and condensing means for condensing said mercury vapor externally of said pipe section.

16. Apparatus according to claim 15 in which said heating means comprises means for heating said inert gas prior to introduction of said inert gas into said pipe section.

17. Apparatus according to claim 15 in which said heating means comprises external heating means for heating the exterior of said pipe section.

18. Apparatus according to claim 15 in which said heating means comprises an internal heating means inserted inside said pipe section.

19. Apparatus according to claim 15 in which said means for introducing said inert gas into the interior of said pipe section and said means for withdrawing said inert gas from said pipe section are arranged in a circuit with said means for condensing said mercury.

20. Apparatus according to claim 19, further including in said circuit of means for reheating said inert gas after condensation of said mercury vapor and before reintroducing said inert gas into said pipe section.

21. Apparatus for removing mercury from a section of a pipe line for transporting natural gas, said pipe line comprising a plurality of interconnected pipe sections, said apparatus comprising means for segregating the interior of a pipe section of said pipe line from adjacent pipe sections, heating means for heating said segregated pipe sections to evaporate any mercury therein, connecting means for connecting with end portions of the interior of said segregated pipe sections a closed circuit inert gas line, said inert gas pipe line comprising means for evacuating said inert gas line to producing pressure lower than atmosphereic pressure therein, means for supplying inert gas to said inert gas line, means for recirculating said inert gas through said inert gas and pipe line and through the interior of said segregated pipe sections to withdraw mercury vapor from the interior of said segregated pipe section and a condenser for condensing mercury vapor withdrawn from the interior of said segregating pipe section.

22. Apparatus according to claim 21, in which said heating means comprises means for heating the exterior of said segregated section and thereby evaporate any mercury in said segregated pipe sections.

* * * * *